United States Patent [19]

Rathbone

[11] Patent Number: 4,790,866

[45] Date of Patent: Dec. 13, 1988

[54] AIR SEPARATION

[75] Inventor: Thomas Rathbone, Walthamstow, England

[73] Assignee: The BOC Group plc, Windlesham, England

[21] Appl. No.: 123,492

[22] Filed: Nov. 20, 1987

[51] Int. Cl.[4] ..... F25J 3/04

[52] U.S. Cl. ..... 62/22; 62/24

[58] Field of Search ..... 62/11, 22, 23, 24

[56] References Cited

U.S. PATENT DOCUMENTS

| | | | |
|---|---|---|---|
| 3,729,943 | 5/1973 | Petit | 62/22 |
| 3,751,934 | 8/1973 | Frishbier | 62/22 |
| 4,575,388 | 3/1986 | Okada | 62/22 |
| 4,615,716 | 10/1986 | Cormier et al. | 62/22 |

*Primary Examiner*—Ronald C. Capossela

*Attorney, Agent, or Firm*—R. Hain Swope; Larry R. Cassett

[57] ABSTRACT

A method and apparatus for the separation of air is described. Air is separated in a double distillation column comprising higher and lower pressure columns, an argon-enriched fluid stream is withdrawn from the lower column and separated in a further distillation column provided with liquid argon reflux from a condenser to yield an argon product. Liquid nitrogen is withdrawn from the high pressure column and reboiled in the condenser to form a gaseous stream. At least part of the gaseous stream is warmed and withdrawn. The withdrawn stream may be taken as product or expanded in a turbine to provide refrigeration.

8 Claims, 3 Drawing Sheets

AIR SEPARATION

This invention relates to a method and plant for separating air.

BACKGROUND OF THE INVENTION

European Patent Application No. 136926 A provides a process for distilling air in a conventional double column which comprises a distillation column operating at a relatively low pressure, a second distillation column operating at a relatively high pressure and a condenser-reboiler which provides condensate as reflux to the relatively high pressure column and reboiled liquid gas to the lower pressure column. Liquid oxygen is taken from one of the columns and is passed to the top of an auxiliary column operating substantially at the pressure of the lower pressure column, a gas less rich in oxygen than the liquid oxygen is taken from the lower pressure column and is passed to the bottom of the auxillary column, and the liquid collected at the bottom of the auxiliary column is passed as reflux into the low pressure column substantially at the level from which the said gas is withdrawn. One of the advantages offered by this process is that when a surplus of oxygen is produced, that is when the rate of production of oxygen is greater than the demand for it, the excess liquid oxygen can, if effect, be used to increase the reflux to the lower pressure column thereby enabling an increase to be made in the amount of argon-enriched fluid that is withdrawn from the lower pressure column for subsequent processing, typically in a further distillation column, to produce a crude argon product.

The present invention provides an alternative method and apparatus which enhances argon production by passing the aforementioned reflux to the argon column rather than to the lower pressure column.

SUMMARY OF THE INVENTION

According to the present invention there is provided a method of separating air in a double distillation column comprising lower and higher pressure distillation columns, comprising the steps of withdrawing an argon-enriched fluid stream from the lower pressure column and separating an argon product from said fluid stream in a further distillation column provided with liquid argon reflux from a condenser, withdrawing liquid nitrogen from the higher pressure column and reboiling it in said condenser, a gaseous stream being formed from the reboiled nitrogen. At least part of the gaseous stream is warmed and withdrawn. The withdrawn portion of the gaseous stream may be taken as product expanded to with the performance of external work, i.e. in a turbine, to provide refrigeration.

The invention also provides a plant for separating air, including a double distillation column comprising lower and higher pressure distillation columns, having an outlet for the withdrawal of an argon-enriched fluid stream, a further distillation column having an inlet in communication with said outlet, mixing means having one inlet in communication with an outlet for the withdrawal of liquid oxygen from the lower pressure column and another inlet in communication with an outlet for the withdrawal of nitrogen vapor from the higher pressure column, a condenser having condensing passages in communication at their inlet ends and at their outlet ends with a top region of the further column, and reboiling passages which are in heat exchange relationship with said condensing passages and in communication at their inlet ends with a passage for liquid nitrogen leading from the mixing means and at their outlet ends with the mixing means, the mixing means having an outlet for gas communicating with a passage that extends through heating means for heating gas withdrawn from said mixing means, which passage terminates in an outlet for product gas or the inlet of an expansion turbine which (if present) has an outlet in communication with a location requiring refrigeration.

BRIEF DESCRIPTION OF THE DRAWING

In the accompanying drawings which illustrate a method and plant according to the invention.

In the drawings like parts are indicated by the same reference numerals.

DETAILED DESCRIPTION OF THE INVENTION

Figure 1:
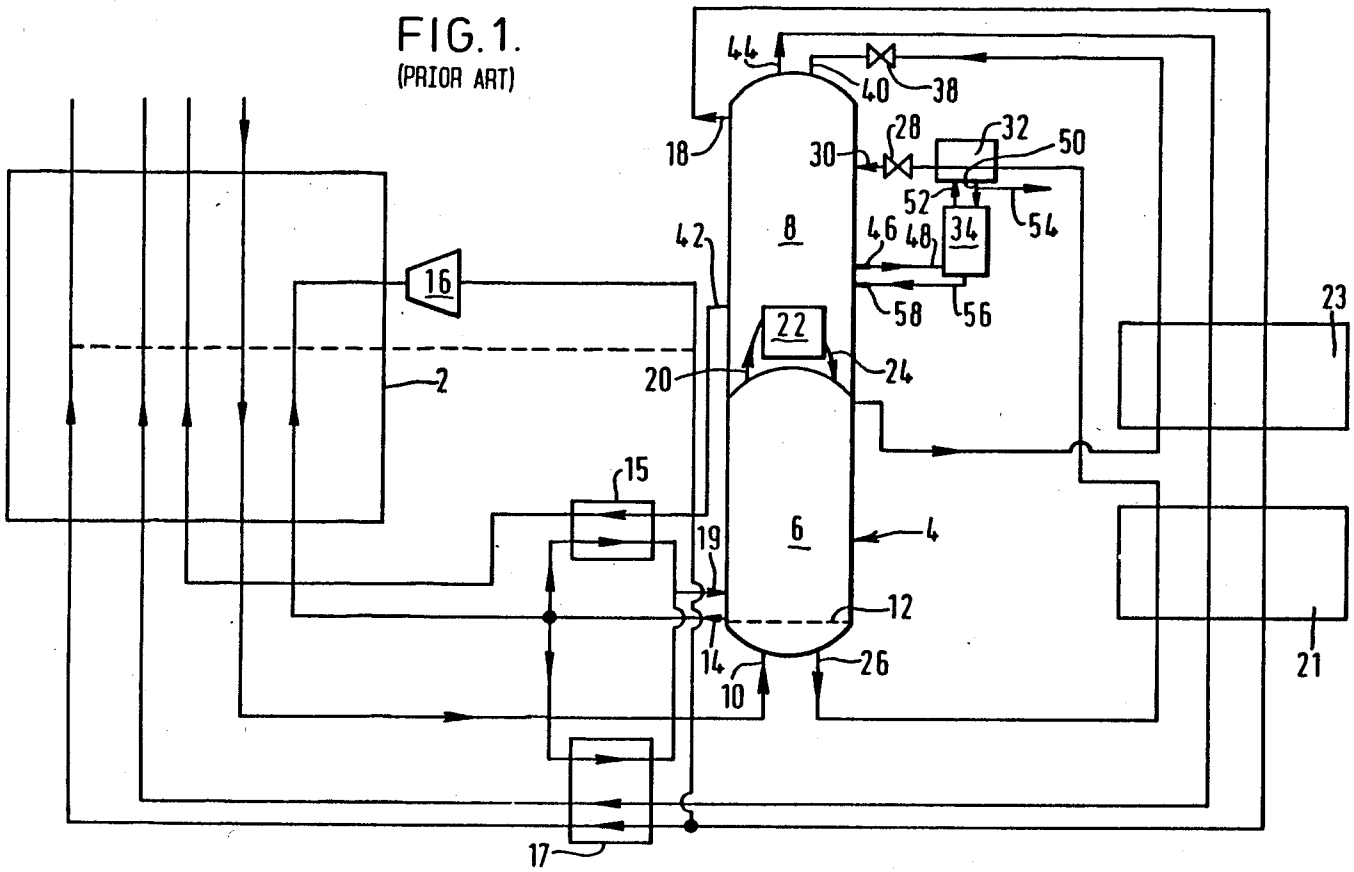
FIG. 1. (PRIOR ART)
FIG. 1 is a schematic circuit diagram illustrating a conventional air separation plant for producing argon and gaseous oxygen and nitrogen products.

Referring to FIG. 1 of the drawings, an air stream at a pressure of about 6.5 atmospheres (absolute) is passed at about ambient temperature into the warm end of a reversing heat exchanger 2 and leaves the cold end of the reversing heat exchanger 2 at a temperature suitable for subsequent separation in a distillation column. The air passes into the higher pressure column 6 of a double column system, indicated generally by the reference numeral 4, through an inlet 10 below the level of a lowest tray 12 in the column. Although all the other trays of the distillation column are of the sieve kind, the lowest tray is preferably of the bubble cap kind and is used to assist in the removal of any relatively volatile constituents of the air, such as water vapor and carbon dioxide that pass through reversing heat exchanger 2 without being deposited as ice in the heat exchanger. A stream of air is withdrawn from the column 6 through an outlet 14 immediately above the tray 12. This stream is returned to the reversing heat exchanger 2 and flows part of the way through the reversing heat exchanger 2 and then is withdrawn therefrom and is expanded in an expansion turbine 16 providing energy external of the system. For example, the turbine may be coupled to a compressor (not shown) employed in the compression of the incoming air stream upstream of the reversing heat exchanger 2.

The turbine 16 is effective to reduce the pressure of the air stream to that of a waste nitrogen stream withdrawn from the lower pressure column of the double column system through an outlet 18. The air from the turbine 16 is merged with this waste nitrogen stream 18 and is returned through the reversing heat exchanger 2 counter-currently to the air stream for separation, leaving the warm end of the reversing heat exchanger 2 at about ambient temperature. The waste nitrogen stream 18 is then typically vented to the atmosphere. The expansion of the air in the turbine 16 is thus able to meet the refrigeration requirements of the process.

The refrigeration provided as described above is preferably the provision of enhanced cooling for at least one of the heat exchangers in which air is cooled upstream of its introduction into the said double column. The method and apparatus according to the invention make possible the attainment of a particularly uniform temperature profile of the stream being warmed relative to streams being cooled in the main heat exchanger or exchangers of the plant. Typically, cooling for the at least one of the heat exchangers is also provided by expanding air withdrawn from a region of said heat exchanger(s) intermediate the cold and warm ends thereof.

The remainder of the stream withdrawn from the column 6 through the outlet 14 is divided into two parts. One part is employed in a heat exchanger 15 to provide warming for a product gaseous oxygen stream withdrawn from the lower pressure column 8, and the other part is employed in a heat exchanger 17 to provide warming for waste and product nitrogen streams that are also withdrawn from the lower pressure column 8. The two parts of the air stream after their respective passages through the heat exchangers 15 and 17 are then recombined and reintroduced into the column 6 through an inlet 19.

As is well known in the art, the higher pressure column 6 is effective to strip nitrogen from the incoming air as a vapor ascends the column countercurrently to a down flow of liquid reflux. The liquid reflux is provided by withdrawing nitrogen from an outlet 20 at the top of the column 6, condensing it in a condenser-reboiler 22 and returning the condensate to the top of the column through the inlet 24. An oxygen-enriched liquid is collected at the bottom of the column 6.

The liquid collecting at the bottom of the column 6 is separated in the lower pressure column 8 and a substantially pure oxygen product is obtained thereby. Thus, oxygen-enriched liquid is withdrawn from the column 6 through an outlet 26, is sub-cooled in a sub-cooler 21, is throttled through throttling valve 28, but downstream of the sub-cooler 21, and is introduced into the lower pressure column 8 through an inlet 30. Upstream of the valve 28, the oxygen-enriched liquid stream is passed through a condenser 32 associated with an argon separation column 34 and thus provides cooling for the condenser 32, being at least partially reboiled itself.

Reflux for the lower pressure column 8 is provided by collecting a part of the liquid nitrogen passing into the top of the column 6 through the inlet 24 and passing this liquid nitrogen through a sub-cooler 23, a throttling valve 38, and then into the top of the column 8 through an inlet 40. A liquid thus flows downwardly through the column 8 in heat exchange relationship with an asending vapor stream with the result that liquid collecting at the bottom of the column 8 is substantially pure oxygen. This liquid is reboiled by the condenser-reboiler 22. A gaseous oxygen product is withdrawn through the conduit 42 communicating with the vaporous oxygen side of the condenser/reboiler 22 and is passed through the heat exchanger 15 countercurrently to the air flow and then through the reversing heat exchanger 2 countercurrently to the incoming air. A waste nitrogen stream is also withdrawn (as aforesaid) through the outlet 18, is warmed by passage through the sub-coolers 23 and 21 and the heat exchanger 17, and is then further warmed by passage through the reversing heat exchanger 2 cocurrently with the product oxygen stream. A product nitrogen stream is withdrawn from the top of the column through an outlet 44 and is similarly passed through the sub-coolers 23 and 21 and heat exchangers 17 and 2.

In order to provide a feed for the argon column 34, a stream of argon-enriched vapor is withdrawn from a level in the column 8 where the local argon concentration is at or near a maximum and is passed from outlet 46 into the column 34 through an inlet 48. The vapor encounters a downwardly flowing liquid stream entering the top of the column 34 from the condenser 32 through an inlet 50. Argon product vapor flows out of the top of the column 34 through an outlet 52 and is condensed in the condenser 32. A part of the resulting liquid argon is withdrawn as product through outlet 54. Liquid collecting at the bottom of the column 34 is withdrawn therefrom through an outlet 56 and is returned to an appropriate level in the column 8 through an inlet 58.

Those skilled in the art will appreciate that a large number of modifications can be made to the plant shown in FIG. 1. For example, it is possible to avoid returning any air for turbine expansion from the high pressure column 6 and instead to take such air directly from the incoming stream of air being cooled in the reversing heat exchanger 2. In another modification, some of the waste nitrogen stream is taken from an intermediate location of the reversing heat exchanger 2 and is mixed with the gas exiting the expansion turbine 16 (as shown by the dotted line in FIG. 1).

Figure 2:
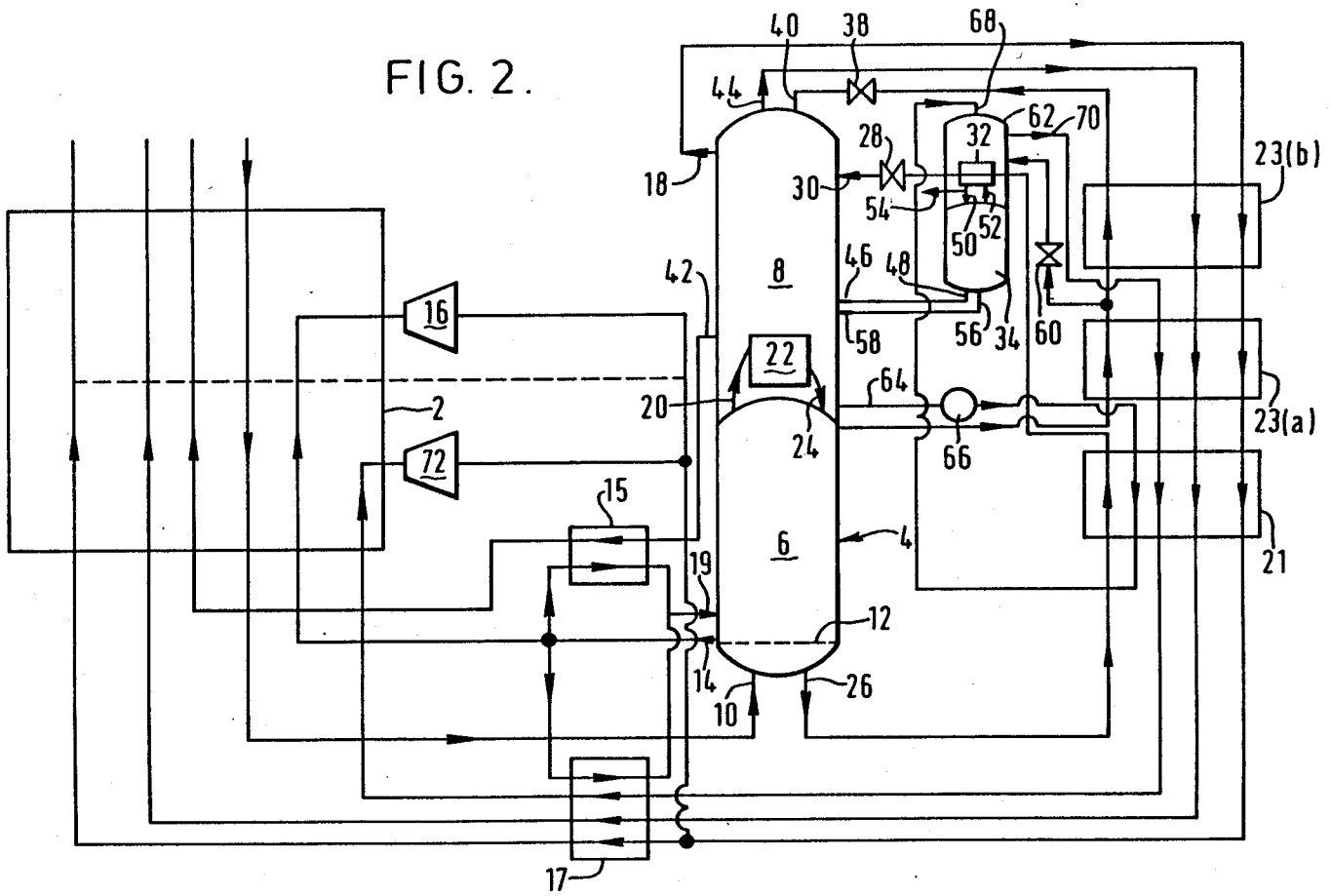
FIG. 2 is a circuit diagram illustrating a first modification to the plant shown in FIG. 1 to enable it to be operated in accordance with the invention.

In FIG. 2 there is illustrated a plant for performing an air separation cycle that is a modification of the cycle operated by the plant shown in FIG. 1.

Those parts of the plant shown in FIG. 2 that are also employed in the plant shown in FIG. 1 are not described again. In the plant shown in FIG. 2, the sub-cooler 23 is in two separate sections 23(*a*) and 23(*b*). In the higher temperature range section 23(*a*) there is cooled the liquid nitrogen stream withdrawn from the column 6 through the outlet 36. A part of this stream is further cooled in the section 23(*b*) prior to its passage through the valve 38. The remainder of the liquid nitrogen stream is passed from the section 23(*a*) of the sub-cooler 23, through an expansion or throttling valve 60 and into an additional liquid-vapor contact column 62 which employs the condenser 32 to reboil the liquid nitrogen. Thus, extra cooling is provided for the condensation of argon and this makes possible a greater rate of production of argon. In the column 62 the vaporized nitrogen is mixed with a stream of liquid oxygen. This stream of liquid oxygen is withdrawn through an outlet 64 from the bottom of the lower pressure column 8 and is pumped by a pump 66 through the sub-cooler 21 countercurrently to the oxygen-rich liquid withdrawn from the higher pressure column 6 through the outlet 26. In sub-cooler 21, the liquid oxygen is warmed to its saturation temperature at the operating pressure of the column. It is then passed into the top of the column 62 through an inlet 68. In the column 62 there is thus a downward flow of liquid that becomes progressively richer in nitrogen and an upward flow of vapor that becomes progressively richer in oxygen.

A mixed oxygen-nitrogen vapor stream is withdrawn from an intermediate level in column 62 (typically corresponding to an oxygen-nitrogen ratio the same as that in the incoming air) through outlet 70 and is passed through the section 23(*a*) of the sub-cooler 23, the sub-cooler 21 and the heat exchanger 17 cocurrently with the product nitrogen and waste nitrogen streams. The mixed oxygen-nitrogen stream then flows through the heat exchanger 2 cocurrently with the product nitrogen and waste nitrogen streams but for only a part of the extent of this heat exchanger and is then withdrawn and expanded to provide energy outside of the system in a second turbine 72. Thus, refrigeration is generated which is utilized to provide cooling for the reversing heat exchanger 17. Accordingly, the gas leaving the outlet of the turbine 72 is merged with the waste nitrogen stream upstream of its entrance to the heat exchanger 2. The energy requirement of the refrigeration imposed upon the air turbine 16 is thus reduced, and accordingly, the amount of air that needs to be withdrawn from the column 6 through the outlet 14 is similarly reduced. Therefore, air is fractionated in the column 4 at a greater rate than in the operation of the plant shown in FIG. 1 and, hence, the argon-enriched vapor stream may be withdrawn from the lower pressure column 8 at a similarly greater rate, and thus the rate of processing the argon-enriched vapor in the column 34 can be matched with the increased refrigeration made available to the condenser 32.

In typical operation of the plant shown in FIG. 2, the higher pressure column 6 may operate at a pressure of about 6.5 atmospheres and the lower pressure column at an average pressure of about 1.7 atmospheres. The argon column 34 operates an average pressure similar to that of the lower pressure column 8, and the pressure at which the liquid-vapor contact column 62 operates is typically on the order of about 2.7 atmospheres, there being a 1.5 K. temperature difference between the boiling liquid nitrogen in the column 62 and the condensing argon returned to the column 34. The turbines 16 and 72 expand their respective gaseous feeds to the pressure of the waste nitrogen stream.

The rate of passage of liquid oxygen and liquid nitrogen into the column 62 may be selected in accordance with the relative demand for oxygen and argon from the plant. It is to be appreciated that the mixing of the liquid oxygen and nitrogen streams in the column 62 will reduce the overall rate of production notwithstanding the increased rate of processing of air in comparison with the plant shown in FIG. 1. Accordingly, the plant shown in FIG. 2 may be constructed so as to provide the choice of shutting off all fluid flows to and from the additional column 62 so that the plant then operates analogously to the one shown in FIG. 1. Such a mode of operation may be chosen when the demand for oxygen is relatively high, but if the oxygen demand falls, the column 62 may be brought into operation so as to increase the rate of argon production by 8%, but at the expense of an 8% reduction in the rate of oxygen production.

Figure 3:
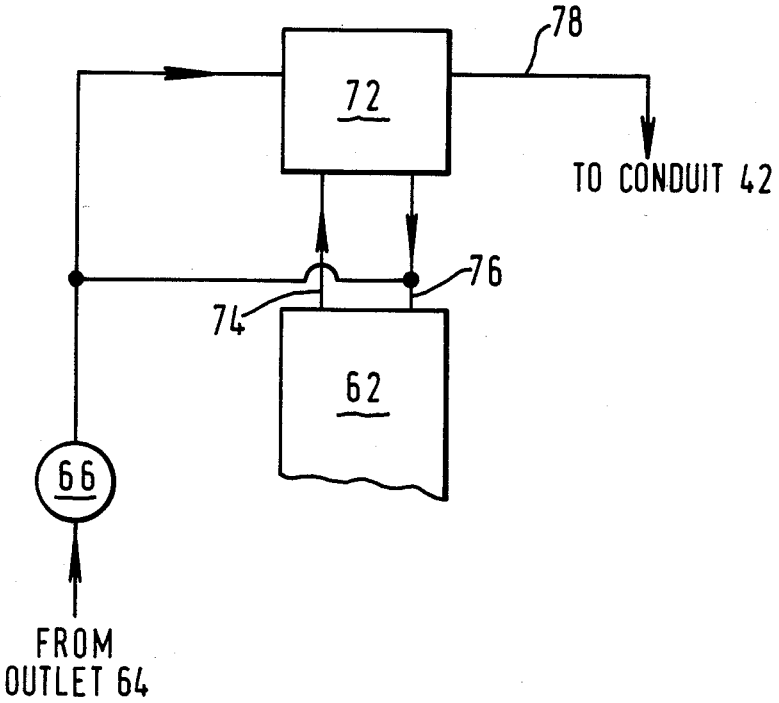
FIG. 3 is a schematic diagram illustrating a modification to a part of the plant shown in FIG. 2.

The efficiency with which the oxygen and nitrogen streams are mixed in the column 62 and hence the overall efficiency of the plant shown in FIG. 2 may be increased by employing the modification illustrated in FIG. 3 of the accompanying drawings. In the modification shown in FIG. 3, not all the liquid oxygen withdrawn through the outlet 64 from the bottom of the lower pressure column 6 is pumped directly into the column 62. Some of the liquid oxygen is employed to provide cooling for a condenser 72 which receives oxygen vapor flowing out of the top of the column 62 through an outlet 74 and returns condensed oxygen liquid back to the top of the column 72 through an inlet 76. The inlet 76 also receives the rest of the liquid oxygen withdrawn from the lower pressure column 8 through the outlet 40. The liquid oxygen stream that provides refrigeration for the condenser 72 is itself reboiled and the resulting oxygen vapor leaves the condenser 72 through an outlet 78 and is then typically merged with the gaseous oxygen product leaving the column 8 through the conduit 42.

The operation of a column of the same kind as the column 62 with a condenser are discussed in more detail in our co-pending application No. 8611536 (published under the Ser. No. 2 174 916A).

I claim:

1. A method of separating air in a double distillation column comprising lower and higher pressure distillation columns, including the steps of withdrawing an argon-enriched fluid stream from the lower pressure column and separating an argon product from said fluid stream in a further distillation column provided with liquid argon reflux from a condenser, wherein liquid nitrogen is withdrawn from the higher pressure column and is reboilded in said condenser thereby providing a portion of the refrigeration therefor, the remainder of said refrigeration being provided by a stream of liquid withdrawn from the bottom of the higher pressure column, said stream of liquid being introduced into the lower pressure column downstream of its passage through the condenser, a gaseous stream is formed by mixing in a vapor-liquid contact column said reboiled nitrogen with oxygen taken from the lower pressure column, there being in said vapor-liquid contact column a downward flow of liquid that becomes progressively richer in nitrogen in the direction of its flow and an upward flow of vapor that becomes progressively richer in oxygen in the direction of its flow, said gaseous stream being withdrawn from an intermediate level in said column, at least part of the gaseous stream formed in said vapor-liquid contact column is withdrawn and warmed, said part of the gaseous stream being taken as product or expanded in a turbine to provide refrigeration.

2. A method in accordance with claim 1, wherein the gaseous stream withdrawn from the vapor-liquid contact column is warmed by heat exchange countercurrently to air being cooled to a temperature suitable for the introduction into said double distillation column.

3. A method in accordance with claim 1 wherein the refrigeration provided by said part of the gaseous stream cools at least one heat exchanger in which air is cooled upstream of its introduction into the said double distillation column.

4. A method in accordance with claim 3, wherein additional cooling for said heat exchanger is provided by expanding air withdrawn from a region thereof intermediate of its cold and warm ends.

5. A method in accordance with claim 1, wherein the oxygen for mixing with said reboiled nitrogen is taken from liquid oxygen at the bottom of the lower pressure column and is warmed to its saturation temperature at the operating pressure of the said vapor-liquid contact column.

6. A method in accordance with claim 1 wherein the gaseous stream withdrawn from the vapor-liquid contact column has a ratio of oxygen to nitrogen approximately the same as the ratio of oxygen to nitrogen in the incoming air for separation.

7. A method in accordance with claim 1, wherein vapor is withdrawn from the top of the liquid-vapor contact column and is condensed in a condenser by heat exchange with liquid oxygen withdrawn from the bottom of the lower pressure column.

8. A method in accordance with claim 7, wherein vaporized oxygen resulting from the heat exchange in the condenser associated with the liquid-vapor contact column is merged with a product gaseous oxygen stream taken from the lower pressure column.

* * * * *

UNITED STATES PATENT AND TRADEMARK OFFICE
CERTIFICATE OF CORRECTION

PATENT NO. : 4,790,866

DATED : Dec. 13, 1988

INVENTOR(S) : Thomas Rathbone

It is certified that error appears in the above-identified patent and that said Letters Patent is hereby corrected as shown below:

Title Page, insert

-- Item [30] FOREIGN APPLICATION PRIORITY DATA

Nov. 24, 1986 [GB] United Kinggom.....8628018
Apr. 3, 1987 [GB] United Kinggom.....8707993 — .

Column 4, after line 28, insert the following three paragraphs:

-- The mixing of the reboiled nitrogen with oxygen taken from the lower pressure column is preferably performed in a vapor-liquid contact column in which there is a downward flow of liquid that, in the direction of its flow, becomes progressively richer in nitrogen and an upward flow of vapor that becomes in its direction of flow progressively richer in oxygen, said gaseous stream being withdrawn from an intermediate level in the column. Typically, the gaseous stream has a ratio of oxygen to nitrogen approximately the same as the ratio of oxygen to nitrogen in the incoming air for separation. If desired, vapor may be withdrawn from the top of the liquid-vapor contact column and condensed by heat exchange with liquid oxygen withdrawn from the bottom of the lower pressure column.

Such condensation may be used to enhance the liquid-vapor ratio in the liquid-vapor contact column and thus improves the efficiency of its operation. The vaporized oxygen resulting from the heat exchange in the condenser associated with the said liquid-vapor contact column is typically merged with a product gaseous oxygen stream taken from the lower pressure column.

UNITED STATES PATENT AND TRADEMARK OFFICE

CERTIFICATE OF CORRECTION

PATENT NO. : 4,790,866

DATED : Dec. 13, 1988

INVENTOR(S) : Thomas Rathbone

It is certified that error appears in the above-identified patent and that said Letters Patent is hereby corrected as shown below:

Preferably, cooling for the condenser associated with the said further distillation column is also provided by a stream of liquid taken from the bottom of the higher pressure column, said stream being introduced into the lower pressure column downstream of its passage through the argon condenser. --.

Signed and Sealed this

Seventeenth Day of October, 1989

*Attest:*

DONALD J. QUIGG

*Attesting Officer*

*Commissioner of Patents and Trademarks*